US006959967B1

(12) United States Patent
Prokop et al.

(10) Patent No.: US 6,959,967 B1
(45) Date of Patent: Nov. 1, 2005

(54) HAMMER WITH HIGH PRESSURE SHUT-OFF

(75) Inventors: Heinz-Jürgen Prokop, Ratingen (DE); Marcus Geimer, Essen (DE)

(73) Assignee: Krupp Berco Bautechnik GmbH, Essen (DE)

( * ) Notice: Subject to any disclaimer, the term of this patent is extended or adjusted under 35 U.S.C. 154(b) by 0 days.

(21) Appl. No.: 09/238,735

(22) Filed: Jan. 28, 1999

(30) Foreign Application Priority Data

Jan. 30, 1998 (DE) ..... 198 03 449

(51) Int. Cl.[7] ..... B28D 1/26
(52) U.S. Cl. ..... 299/69; 173/206
(58) Field of Search ..... 299/69; 173/206, 173/207

(56) References Cited

U.S. PATENT DOCUMENTS

| | | | | |
|---|---|---|---|---|
| 3,664,435 A | | 5/1972 | Klessig | |
| 3,965,799 A | * | 6/1976 | Juvonen et al. | 91/220 |
| 4,006,783 A | * | 2/1977 | Granholm | 173/177 |
| 4,062,411 A | * | 12/1977 | Adkins et al. | 173/115 |
| 5,417,294 A | * | 5/1995 | Suher | 173/15 |
| 5,653,295 A | | 8/1997 | Juvonen et al. | |

FOREIGN PATENT DOCUMENTS

| | | |
|---|---|---|
| DE | DT 2443800 A1 * | 3/1975 |
| DE | 27 37 081 | 3/1979 |
| DE | 40 36 918 A1 | 5/1992 |
| DE | 41 28 137 A | 2/1993 |
| EP | 0 752 297 A2 | 1/1997 |

* cited by examiner

*Primary Examiner*—John Kreck
(74) *Attorney, Agent, or Firm*—Venable LLP; Robert Kinberg; Catherine M. Voorhees

(57) ABSTRACT

A fluid-powered impact vibrator (5), in particular a hydraulic hammer, comprising a fluid-powered percussion hammer (8) with a percussion piston (18) that is moved back and forth under the effect of a control means (10) and comprising a guide unit (7) on which the percussion hammer is supported, wherein the impact vibrator is additionally provided with a control valve, designed as a pressure monitor, for adaptation to the supplied input power. The control valve preferably is a pressure shut-off valve or a pressure-limiting valve (25) that is connected to the input pressure line (3) provided with the operating pressure, and automatically stops the percussion hammer (8) if the operating pressure resulting from the input power exceeds a specified maximum value. To stop the percussion hammer (8), either the pressure line (3) is blocked or the control means (10) is held in one of its end positions, i.e., the operating stroke or the return stroke positions. Moreover, the pressure shut-off valve or the pressure-limiting valve (25) preferably is a component of the guide unit, consisting of a support frame (7), or the percussion hammer (8) itself.

8 Claims, 7 Drawing Sheets

HAMMER WITH HIGH PRESSURE SHUT-OFF

REFERENCE TO RELATED APPLICATIONS

This application claims the priority of German application Serial No. DE 19803449.8, filed Jan. 30, 1998, which is incorporated herein by reference.

BACKGROUND OF THE INVENTION

The invention relates to a fluid-powered impact vibrator, in particular a hydraulic hammer, comprising a fluid-powered percussion hammer or striking tool with a percussion piston, the back and forth movement of which is effected by a control arrangement, as well as a guide unit on which the percussion hammer is supported, and wherein the impact vibrator is additionally provided with a control valve, designed to function as a pressure monitor for adapting the system to the supplied input power.

Fluid-powered impact vibrators—used in particular for crushing rock, concrete or other building materials—for the most part are used as accessory units or attachments for construction machinery, e.g., excavators, loaders or other basic equipment.

Such an application case is illustrated and described, for example, in the German published patent application DE 40 36 918 A1, wherein the impact vibrator is attached to the jib of a fluid-powered excavator and is connected via an input pressure line as well as a return-flow line to the supply unit for the fluid-powered excavator.

The guide unit supporting the percussion hammer itself can be designed to function as its housing (hammer box) or also in the form of a support frame.

The percussion piston movement in the operating or working stroke direction or the opposite, return stroke direction is effected by a control means or arrangement that is associated with or integrated into the percussion hammer. In particular, the control means can be provided with a spool valve acting upon two annular percussion piston surfaces of different size, which are located in opposite movement direction, such that the smaller annular surface (effective in the return stroke direction) is always connected to the input pressure line, and the larger annular surface (effective in the operating stroke direction) is connected via the spool valve alternately to the pressure line and the return-flow line.

Owing to the fact that the hydraulic fluid supplied to the construction machinery, which fluid provides the input power for the subsequently connected impact vibrator, is designed for the internal power demands of the construction machinery itself, a retrofitting with control mechanisms is required in each case to start up the impact vibrator, so as to adapt the subsequently-connected impact vibrator to the supply unit of the respective construction machine, in particular with respect to the operating pressure. This retrofitting can be very involved and also takes for granted that suitable control mechanisms are available in each case.

The European published patent application EP 0 752 297 A2 already discloses a fluid-powered impact vibrator of the generic type, having a control valve for adapting the impact vibrator to an excessively small hydraulic mass flow, so as to ensure the necessary single-impact energy for the material crushing. This control valve, which is spring-activated and is integrated into the percussion hammer itself, reduces the number of impacts by increasing the outflow resistance, thus resulting in an adaptation to the supplied operating fluid mass flow.

The known suggestion for a solution results in an adaptation to the available input power, but only under the aforementioned circumstances, wherein the power for which the impact vibrator is designed cannot be utilized. If an excessive amount of input power is supplied, the control valve is not effective as adaptation arrangement, so that the construction machinery itself that supplies the input power must be additionally retrofitted, as mentioned above.

It is the object of the invention to provide a fluid-powered impact vibrator of the aforementioned generic type such that it can be used for construction machinery having differently designed supply units, without requiring an additional retrofitting with control mechanisms. In other words, the impact vibrator itself should be designed such that its percussion hammer—independent of the input power made available by the associated supply unit—is secured against intolerable operating conditions, such as excessive stress.

SUMMARY OF THE INVENTION

The above object generally is achieved according to the present invention by a fluid-powered impact vibrator, in particular a hydraulic hammer, which comprises a fluid-powered percussion hammer with a percussion piston (18) that is moved back and forth under the effect of a control means and has a guide unit on which the percussion hammer is supported, with the impact vibrator additionally being provided with a control valve, designed as a pressure monitor, for adaptation to the supplied input power. The control valve is a pressure shut-off valve or a pressure-limiting valve that is connected to the input pressure line with the operating pressure, and automatically stops the percussion hammer if the operating pressure resulting from the input power exceeds a specified maximum value. To stop the percussion hammer, either the inlet pressure line is blocked or the control means is held in one of its end positions, i.e., the operating stroke or the return stroke positions. Moreover, the pressure shut-off valve or the pressure-limiting valve is a component of the guide unit, consisting of a support frame, or of the percussion hammer itself.

The idea upon which this approach according to the invention is based is that the control valve, consisting of a pressure shut-off valve or a pressure-limiting valve, is connected to the pressure line provided with or which receives the operating pressure and that if the operating pressure caused by the input power exceeds a specified maximum value, the percussion hammer shuts down automatically, in that either the pressure line is blocked or the control means is held in one of its end positions, namely the operating stroke position or the return stroke position. With respect to the percussion hammer, the pressure shut-off valve or the pressure-limiting valve accordingly is designed such that the percussion hammer and its control means are not subjected to unnecessarily high stress as a result of the supplied operating fluid.

Due to the fact that the pressure shut-off valve or the pressure-limiting valve as a component of the guide unit or the percussion hammer itself, meaning as a component of the impact vibrator, is effective in stopping the percussion hammer, if necessary, the impact vibrator can be used without retrofitting for construction machinery that is designed such that the input power varies. Accordingly, the impact vibrator is ready for operation at the location of use, without requiring a retrofitting that may be necessary to avoid possible excess stress.

Within the framework of the invention, the pressure shut-off valve or the pressure-limiting valve in particular can also be a component of and can be integrated into the percussion hammer itself. Should the operating pressure acting upon the impact vibrator via the intermediate pressure shut-off valve have or assume an unacceptably high value, the pressure shut-off valve is moved automatically to the blocked position, which causes an interruption in the energy supply to the impact vibrator. In order to restart the impact vibrator, it is only necessary to adapt the respective input power supplied by the supply unit, e.g., by reducing the speed of the associated pump unit.

The subject-matter of the invention can be modified further in that the pressure shut-off valve or the pressure-limiting valve is connected via an auxiliary line to the control means, in such that the control means is blocked in one of its end positions when the maximum operating pressure value at the pressure shut-off valve or the pressure-limiting valve is exceeded. In particular, such a blocking occurs if a control surface acting upon the control means is correspondingly provided with pressure under the effect of the respective control valve. For the embodiment in question, the pressure shut-off valve or the pressure-limiting valve acts directly upon the control means, with the result that the control means is finally held in a specified end position and the percussion hammer consequently does not carry out further impacts.

The pressure shut-off valve in particular can be provided with a double piston, having on the one hand a reset that is effective in the direction of the opened position and, on the other hand, a valve chamber that is effective in the opposite direction. The latter preferably is connected on the input side via a control or crossover line to the pressure line. Thus, if the operating pressure that is present on the input side of the pressure shut-off valve assumes an unacceptably high value, the double piston moves counter to the effect of the reset and into the blocked position, in which the connection between input side and output side is disrupted.

In order to monitor the operating pressure, the pressure-limiting valve is connected on the input side to the pressure line that is provided with the operating pressure and from which a switching line goes out as well. The pressure-limiting valve can furthermore be designed and controlled such a way that while it is in the opened position and after the maximum operating pressure value is exceeded, it blocks the control means in the operating stroke position.

Differing from the previously mentioned embodiment, the pressure-limiting valve can also be connected via a switching line to the pressure input line provided with the operating pressure, and can be connected on the output side to a non-pressurized return-flow line. In that case, the control means is designed such that it is blocked in the return stroke position if the pressure-limiting valve assumes its opened position when the maximum operating pressure value is exceeded.

The embodiment provided with a pressure shut-off valve can be further modified in that the pressure shut-off valve is connected via a control line to the pressure line, provided with the operating pressure, and designed such that it assumes the blocked position if the maximum operating pressure value is exceeded. As a result, the reversing line that is connected to the pressure shut-off valve and allows the control means to change to the operating stroke position is blocked.

The percussion hammer should be structurally designed for the highest possible pressure made available via the input line, in order to ensure that the percussion hammer is always protected against an unacceptably high operating pressure, even if the pressure shut-off valve or the pressure-limiting valve is used. This aspect can be met by designing the percussion hammer statically such that it can withstand the highest possible pressure (through corresponding dimensioning of its wall thickness and its other components). In this case, the highest possible pressure can be determined by taking into account the relevant characteristic values for the construction machinery or the associated supply units, which have been introduced to the market and might be considered for a joint operation with the impact vibrator.

It is understood that the impact vibrator, which operates autonomously with respect to the supplied input power, should have quick change attachments to facilitate the connection to the pressure line and the return-flow line of the respectively associated supply unit.

The invention is explained in further detail below with the aid of exemplary embodiments shown in the drawings.

BRIEF DESCRIPTION OF THE DRAWINGS

FIG. 1 is a schematic diagram of a fluid-powered excavator as the basic equipment, to which a fluid-powered impact vibrator is attached such that it can be turned on.

DETAILED DESCRIPTION OF THE PREFERRED EMBODIMENTS

Figure 1:
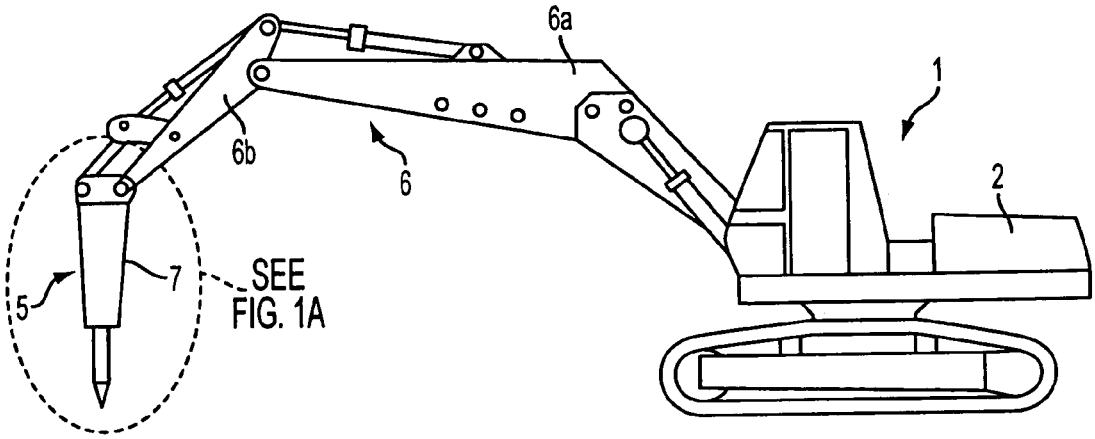

The fluid-powered excavator 1, shown in FIG. 1, is provided with a supply unit 2 (comprising essentially a non-shown diesel motor and a fluid-powered pump operated by this diesel motor) which, e.g., as known from the German reference DE 40 36 918 A1, is connected via a pressure line 3 and a non-pressurized return-flow line 4 (See also FIG. 1*a*) to a fluid-powered impact vibrator 5. The vibrator 5 is held with two jib arms or booms 6*a*, 6*b* on the jib 6 of the fluid-powered excavator, such that it can be turned on.

A support frame 7 functions as a guide unit for the impact vibrator 5 and is attached such that it can be tilted with respect to the jib 6*b*. A fluid-powered percussion hammer 8, e.g., as shown in FIG. 3, is supported on this frame 7.

A tool in the form of a chisel 9 projects from the support frame 7, upon which the percussion hammer acts in the known manner.

Figure 1A:
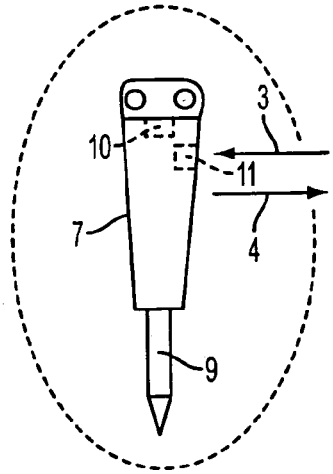
FIG. 1*a* is a schematic diagram of the impact vibrator shown in FIG. 1, including the control means and the additional control valve.

The diagram in FIG. 1*a* furthermore shows that the impact vibrator 5 has a control means (arrangement or mechanism) 10 and additionally a control valve 11, designed as a pressure monitor, for adaptation to the fluid-powered input power that is provided by the supply unit 2.

Figure 3:
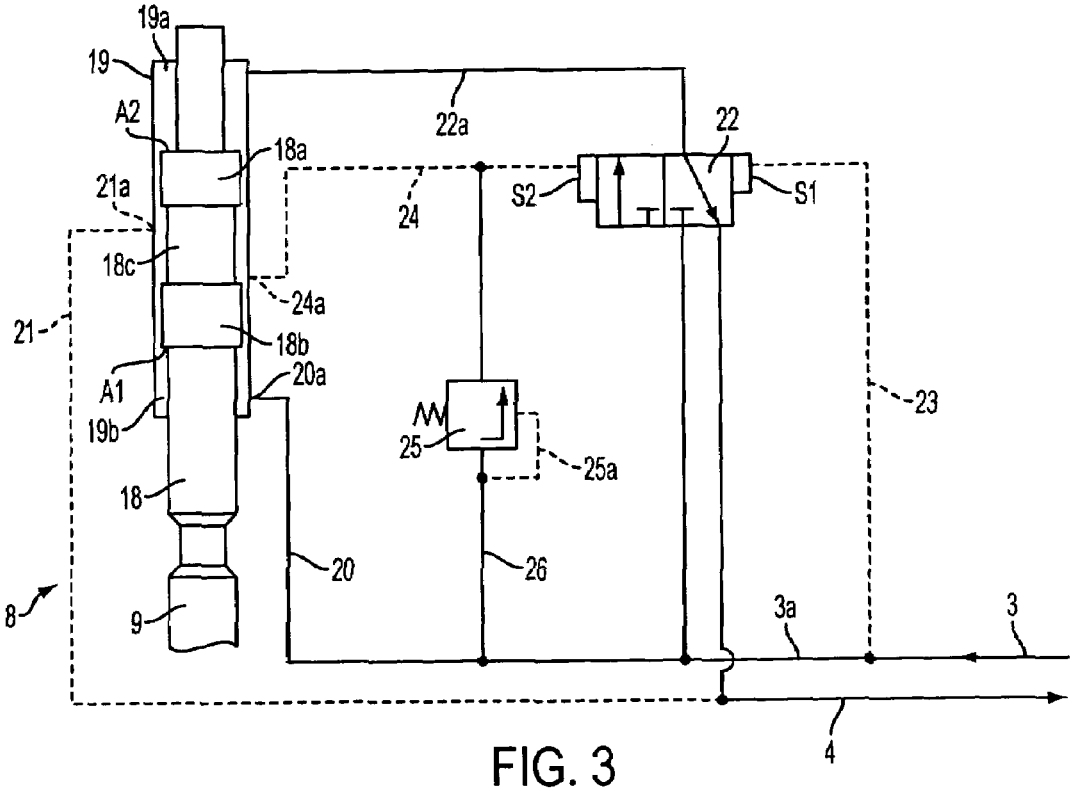
FIG. 3 is a schematic connection diagram for the fluid-powered percussion hammer as a component of the impact vibrator shown in FIGS. 1 and 1*a*, and having a control valve in the form of a pressure-limiting valve integrated into this percussion hammer which, in the opened position, blocks the control means in the operating stroke position after the maximum operating pressure value is exceeded.

Within the framework of the invention, the control valve 11 can be a component of the support frame 7 or of the percussion hammer 8, or can be integrated into the latter (e.g., See also FIG. 3).

Figure 2:
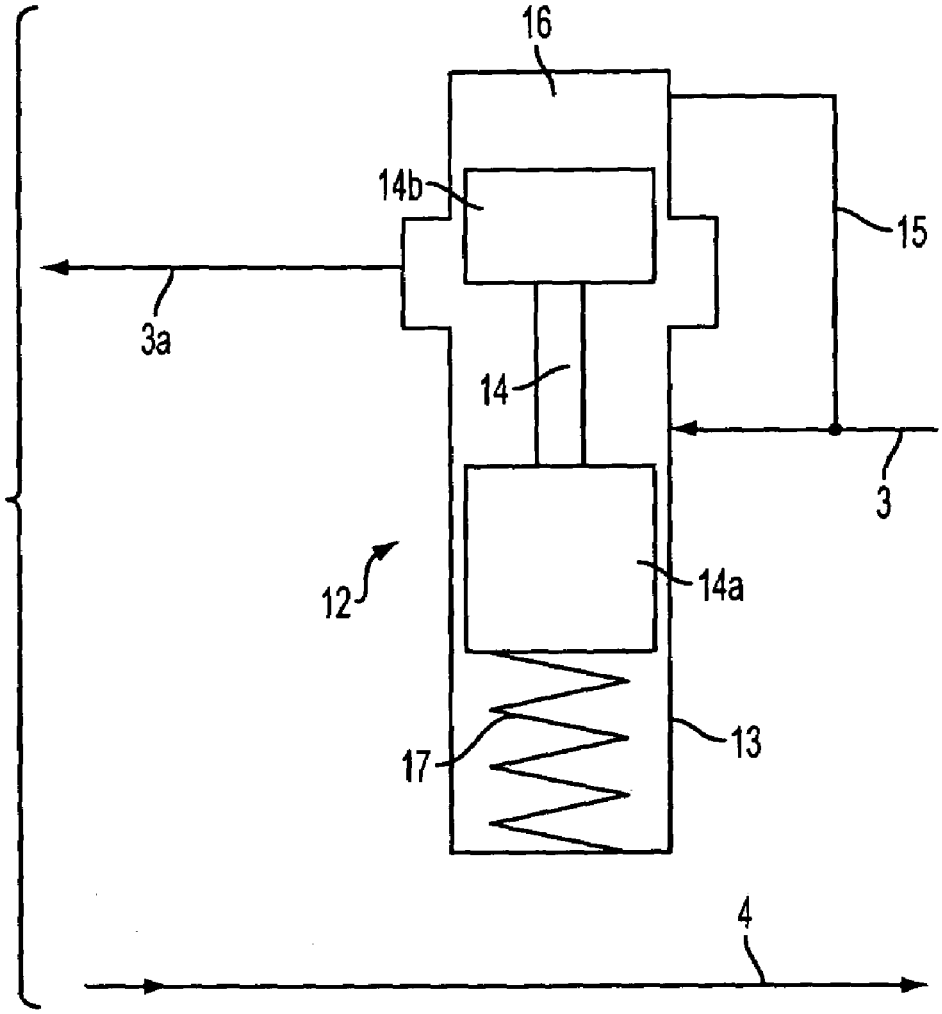
FIG. 2 is a schematic diagram of a control valve in the form of a pressure shut-off valve which is connected to the pressure line that is connected to the percussion hammer.

One particularly simple embodiment of the subject-matter of the invention is shown in FIG. 2 and provides that the pressure shut-off valve 12 functions as a control valve which is connected to the input pressure line 3 that is provided with the operating pressure and is connected to the percussion hammer 8. As indicated in FIG. 1*a*, the pressure shut-off valve 12 is a component of the support frame 7.

According to FIG. 2, the pressure shut-off valve 12 has a double piston 14 inside a cylinder housing 13. This piston 14 is designed and controlled such that it connects the input pressure line 3 with its extension 3*a* on the output side, but only if the operating pressure in the pressure line 3 does not exceed a predetermined maximum pressure value. For this purpose, the housing 13 is provided with a control line 15 that is connected to the input pressure line 3. On the side of double piston 14, this control line 15 empties into a valve chamber 16 that is positioned opposite the side 14*a* of the double position 14 acted upon by a reset spring 17. Under the effect of the aforementioned reset spring 17, the double piston 14 strives to assume the illustrated opened position where the lines 3 and 3*a* are connected as long as the counter force produced via line 15, and acting upon the end 14*b* of the double piston 14 in the valve chamber 16, does not exceed the reset force of spring 17. Otherwise, the double piston 14 moves downwardly from the illustrated position and finally reaches the blocked position, in which the connection between the lines 3 and 3*a* is interrupted. The percussion hammer 8 (e.g., See FIG. 3) which is control-technically connected in line after the pressure shut-off valve 12, is consequently stopped by shutting off the fluid pressure energy supply.

Within the scope of this invention, the percussion hammer 8 as a component of the impact vibrator 5 can have an optional design. This is particularly true with respect to its control means or arrangement 10.

In the embodiment according to FIG. 3, the percussion hammer 8 has a percussion piston 18, which is installed such that it can move back and forth in the longitudinal direction inside a working cylinder 19 and which operates jointly with the aforementioned chisel 9.

The percussion piston 18 has two piston collars 18*a* and 18*b*, located in the cylinder chamber 19, which are separated by a reduced diameter portion 18*c* formed by a circumferential groove. Together with the operating cylinder 19, the outward facing piston surfaces A1 and A2 of piston collars 18*b* and 18*a*, respectively, have a rear and a front cylinder chamber segment 19*a* or 19*b*. In this piston arrangement, the active portion the piston surface A1 is smaller than that of piston surface A2.

In contrast to the larger piston surface A2, the smaller piston surface A1 is constantly subjected to operating pressure (system pressure) via a reset line 20, originating at the extension 3*a* of pressure line 3. With respect to the operating cylinder 19, the discharge opening 20*a* of reset line 20 is arranged in such a way that it is always located outside of the piston collar 18*b* and thus inside the front cylinder chamber segment 19*b*. The cylinder chamber of operating cylinder 19 (on the left side in FIG. 3) is provided with a line 21 that connects into the return-flow line 4. The associated opening 21*a* that discharges into the cylinder chamber is arranged such that it is located between the piston collars 18*a* and 18*b* for the indicated impact position of the percussion piston 18.

A 2/2-way valve 22 functions as the control means (with reference "10" in FIG. 1*a*) for switching or controlling the movement of the percussion piston 18. This valve 22 has two different size control surfaces; namely a smaller control surface S1 and a larger control surface S2 that face in opposite directions. The smaller control surface S1 is connected via a control line 23 to the extension 3*a* of pressure line 3 and, accordingly, is effective as a reset. Via a reversing line 24, the larger control surface S2 is connected on the one hand to the output of a pressure-limiting valve 25 and, on the other hand, to the cylinder chamber. For the illustrated impact position of percussion piston 18, the discharge opening 24*a* of the reversing line is located between the piston collars 18*a* and 18*b*, relative to the operating cylinder 19. In the illustrated embodiment, the discharge opening 21*a* is positioned farther away from the front cylinder chamber segment 19*b* than the discharge opening 24*a*. The pressure-limiting valve 25 which is connected on the input side to the extension 3*a*, is provided with the operating pressure in that it is connected via an auxiliary line 26 from which a control line 25*a* also goes out, to the line extension 3*a*.

The 2/2-way valve 22 furthermore is connected on the one hand to the extension 3*a* and the return-flow line 4 on the input side and, on the other hand, to the rear cylinder chamber segment 19*a* on the output side via a reversing line 22*a*.

Depending on the position of percussion piston 18 inside the operating cylinder 19, the 2/2-way valve 22 is activated under the influence of its control surfaces S1 and S2, such that it connects the rear cylinder chamber segment 19*a* alternately to the extension 3*a* or the return-flow line 4. Counter to the reset effect exerted by the smaller control surface A1, the percussion piston 18 consequently is operated either in an operating stroke direction (e.g., downward as shown in the illustration) or in return stroke direction.

By installing the pressure-limiting valve 25 in between, it is ensured that the percussion hammer 8 is automatically stopped upon exceeding the maximum operating pressure value, adjusted at the pressure-limiting valve 25.

If the operating pressure specified at the pressure-limiting valve 25 exceeds the specified maximum value, the aforementioned control valve 25 opens and establishes a connection between the lines 3*a* and 24. Depending on the position of the percussion piston 18 inside the operating cylinder 19, the 2/2-way valve 22 is consequently moved under the effect of the operating pressure, present at the larger control surface S2, to the operating stroke position not shown here and is held in this position.

As a result of integrating the pressure-limiting valve via the auxiliary line 26 to fit between the lines 3*a* and 24, the control means in the form of the 2/2-way valve 22 is blocked, and the impact vibrator is consequently stopped, when the operating pressure exceeds the maximum value adjusted at the pressure-limiting valve 25.

Figure 4:
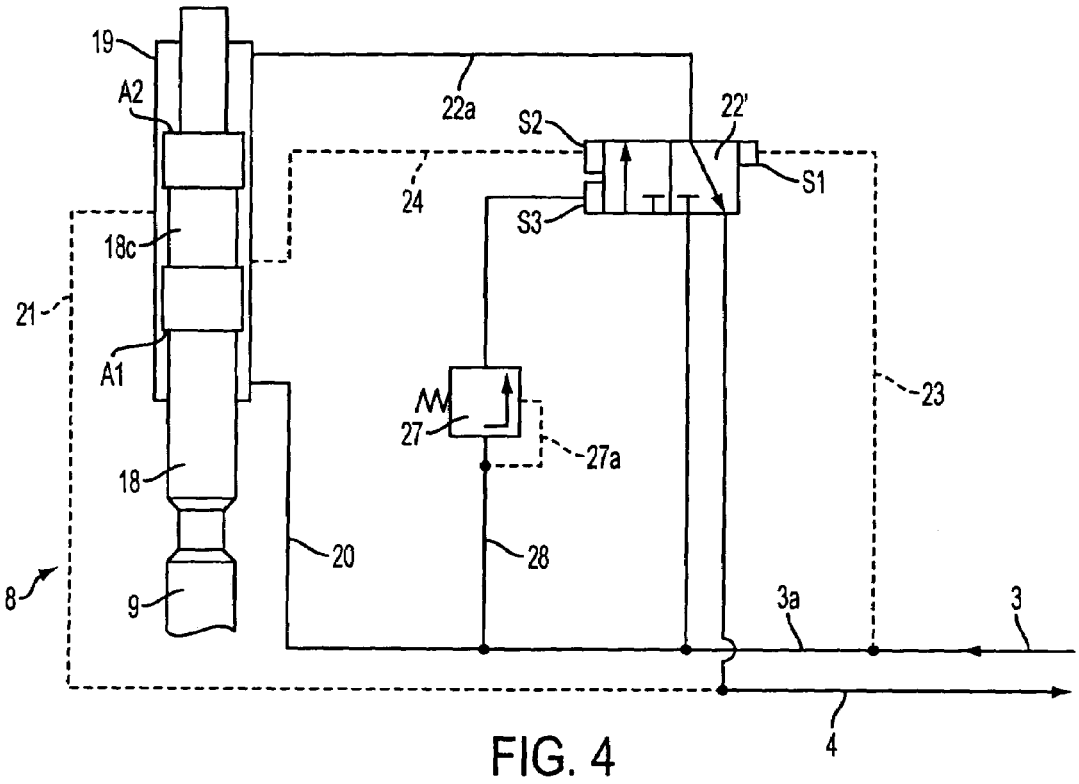
FIG. 4 is a schematic connection diagram for the fluid-powered percussion hammer (as a component of the impact vibrator shown in FIGS. 1, 1*a*), having a differently designed pressure-limiting valve as compared to FIG. 3.

In the embodiment according to FIG. 4, a pressure-limiting valve 27 is additionally connected to the control means which is in the form of the 2/2-way valve 22'. This pressure-limiting valve 22' is connected on the input side via an auxiliary line 28, from which the control line 27*a* of valve 27 goes out as well, to the extension 3*a* of pressure line 3, and is connected on the output side to a third control surface S3 of the 2/2-way valve 22'. The third control surface S3 is also dimensioned larger than the control surface S1 and is effective in the direction of the operating stroke position of the 2/2-way valve, not shown here, if provided with pressure. If the operating pressure present on the input side at the pressure-limiting valve 27 exceeds the specified maximum value, the pressure-limiting valve 27 is moved to the opened position that is not shown. As a result, the 2/2-way valve 27 finally assumes the operating stroke position and is blocked in this position, that is to say independent of the position of the percussion piston 18 inside the cylinder chamber 19. Due to the blocking of the control means or valve 22' in the aforementioned end position, the percussion piston 18 meanwhile cannot carry out further impacts.

Figure 5:
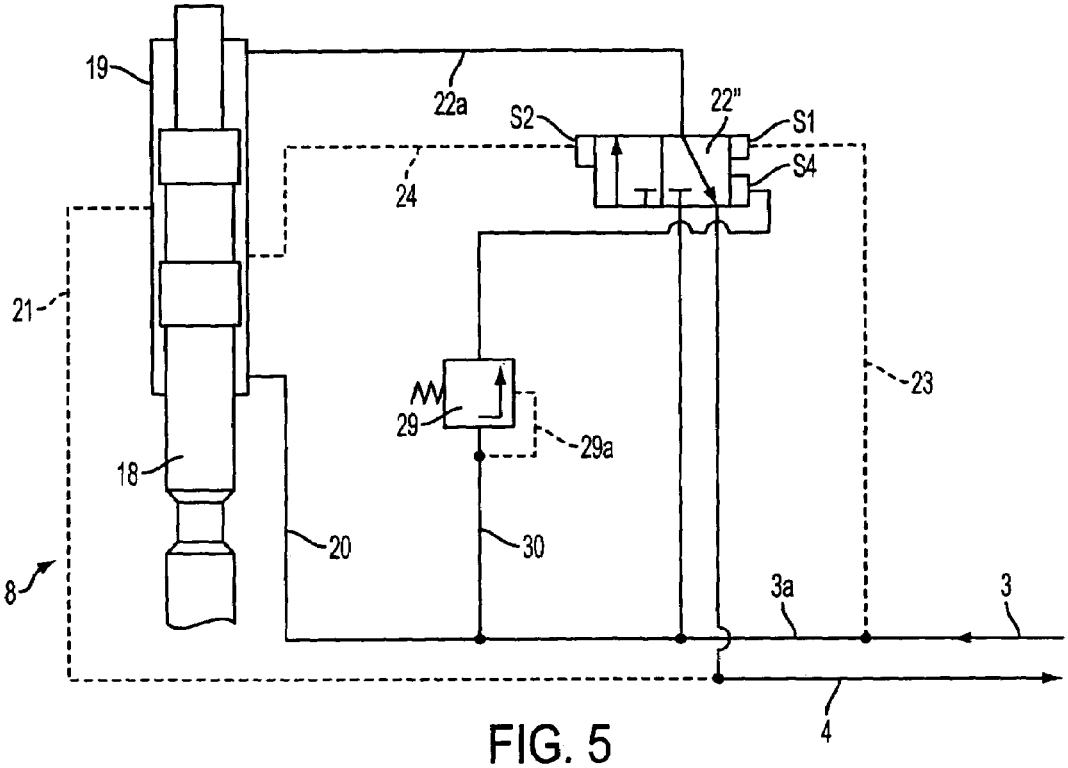
FIG. 5 is a schematic connection diagram of the fluid-powered percussion hammer (as a component of the impact vibrator shown in FIGS. 1, and 1*a*), having a control valve in the form of a pressure-limiting valve, which blocks the control means in the return stroke position, if necessary.

The embodiment according to FIG. 5 differs from the embodiment according to FIG. 4 in that the control means, if necessary, is blocked in a different end position. In that case, a pressure-limiting valve 29 with a control line 29*a* that discharges on the input side into the auxiliary line 30 is connected in front of the control means in the form of a 2/2-way valve 22".

On the output side, the pressure-limiting valve 29 is connected via the auxiliary line 30 to a control surface S4. This control surface S4 is effective in the direction of the return stroke position, i.e., in the same way as the smaller control surface S1, and is dimensioned such that together with the smaller control surface S1, it produces a higher reset force, if necessary, than the control surface S2 that is effective in the opposite direction. Thus, if the operating pressure present on the input side at the pressure-limiting valve 29 exceeds the specified maximum pressure, the pressure-limiting valve 29 is moved to the opened position. As a result, the 2/2-way valve 22" is held in the illustrated return stroke position and additional impacts by the percussion piston 18 are prevented.

Figure 6:
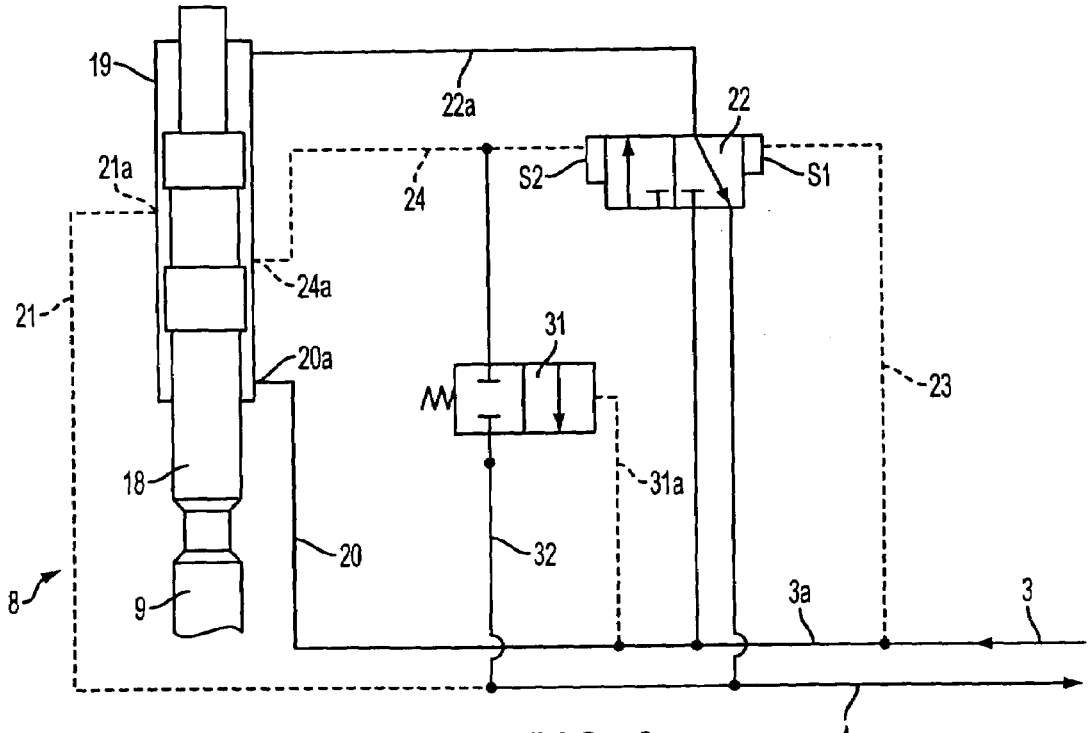
FIG. 6 is a schematic connection diagram for the fluid-powered percussion hammer (as a component of the impact vibrator shown in FIGS. 1, and 1*a*), having a pressure-limiting valve that connects the control line of the control means to a non-pressurized return-flow line if the maximum operating pressure value is exceeded.

The embodiment according to FIG. 6 also has a pressure-limiting valve 31 (shown in a different way), which operates jointly with the control means in the form of the 2/2-way valve 22. In this case, the pressure-limiting valve 31 is connected on the one hand via an auxiliary line 32 to the non-pressurized return-flow line 4 and, on the other hand, to the reversing line 24, which acts upon the larger control surface S2 of valve 22. The pressure-limiting valve 29 is furthermore connected control-technically via a control line 31*a* to the extension 3*a* of the input pressure line 3.

If the operating pressure in the control line 31*a* exceeds the specified maximum value, the pressure-limiting valve 31 is moved from the illustrated blocked position to the opened position and the reversing line 24, which is thereby connected to the return-flow line 4, is relieved from pressure. As a result, the 2/2-way valve 22 is held in the illustrated return stroke position and the percussion piston 18 cannot perform further operating movements. The advantage of this embodiment is that the reversing line 24 is relieved from pressure by way of return-flow line 4 if the existing operating pressure is excessive.

Figure 7:
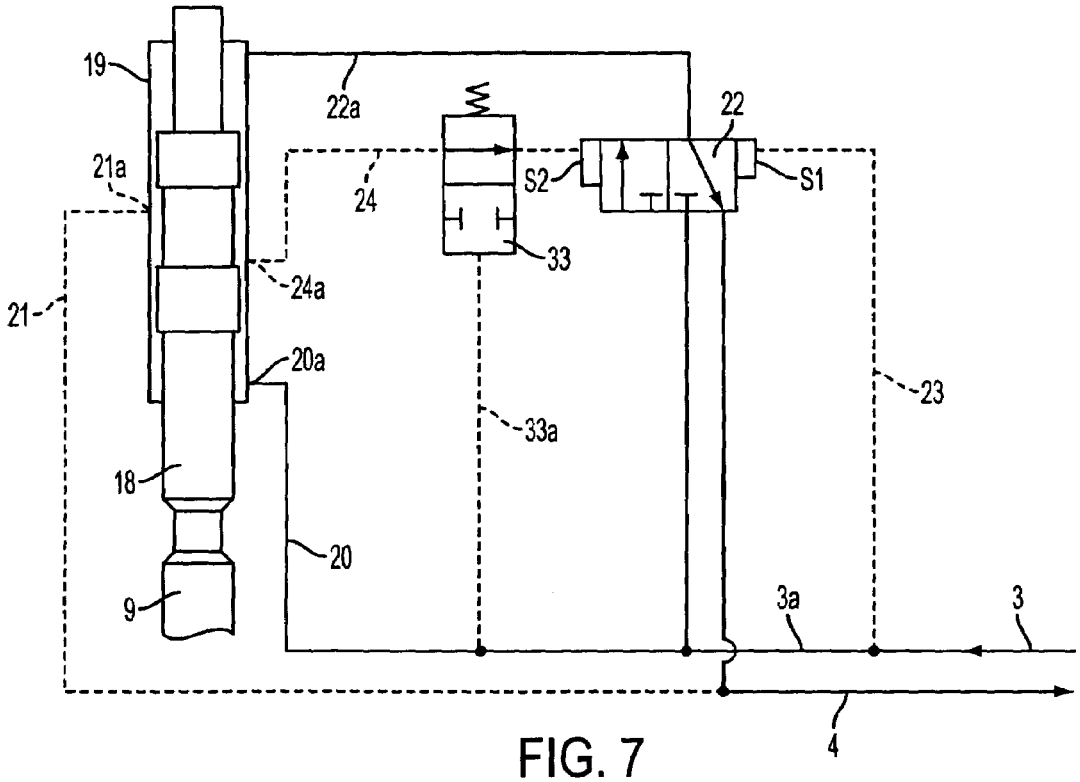
FIG. 7 is a schematic connection diagram of the fluid-powered percussion hammer (as a component of the impact vibrator shown in FIGS. 1, 1*a*), having a pressure shut-off valve, which blocks the control line of the control means when the maximum operating pressure value is exceeded.

In the embodiment according to FIG. 7, the control valve in the form of a pressure shut-off valve 33 is installed directly into the reversing line 24 of the 2/2-way valve 22, wherein the associated switching or control line 33*a* empties into the extension 3*a* of the pressure line 3.

If the operating pressure present in the switching line 33*a* exceeds the specified maximum value, the pressure shut-off valve 33 is moved from the illustrated open position to the blocked position. The reversing line 24 is consequently blocked in the direction of the 2/2-way valve 22, which is held in one end position, thereby preventing further operating movements of the percussion piston 18.

The advantage achieved with the present invention is that the externally supplied input power can be adapted with simple technical means to the differently designed and configured supply units. As a result, a retrofitting of the basic equipment, which may be very involved, can be omitted. The embodiment according to the invention results in an automatic stopping of the impact vibrator 5 if the operating pressure acting upon it reaches inadmissibly high values.

In order to ensure that the impact vibrator 5 is not unduly stressed even if the control valve, e.g., the valve 22, does not function properly, the impact vibrator should on the whole be designed such that it can statically meet the maximum pressure, which can be produced by a supply unit to be considered and already introduced to the market.

The invention now being fully described, it will be apparent to one of the ordinary skill in the art that many changes and modifications can be made thereto without departing from the spirit or scope of the invention as set forth herein.

What is claimed is:

1. A fluid-powered impact vibrator comprising:

a fluid-powered percussion hammer having a percussion piston that can be moved back and forth within a cylinder housing by controlled fluid pressure, and a guide unit on which the percussion hammer is supported;

control means, connected between a fluid pressure inlet line and a pressure inlet to the cylinder housing, for controlling the back and forth movement of said percussion piston, with the control means including a valve moveable between operating stroke and return stroke positions for the percussion piston;

and a control valve which is a component of one of the guide unit and the percussion hammer itself, and which is one of a pressure shut-off valve and a pressure-limiting valve, connected to the pressure inlet line for monitoring the fluid pressure in the pressure inlet line, and connected to the control means for causing the percussion hammer to be stopped automatically by at least one of blocking the pressure inlet line and holding the control means in one of its operating stroke and return stroke positions if the operating pressure in the fluid pressure inlet line exceeds a specified maximum value.

2. A fluid-powered impact vibrator comprising:

a fluid-powered percussion hammer having a percussion piston that can be moved back and forth within a cylinder housing by controlled fluid pressure, and a guide unit on which the percussion hammer is supported;

control means, connected between a fluid pressure inlet line and a pressure inlet to the cylinder housing, for controlling the back and forth movement of said percussion piston, with the control means including a valve moveable between operating stroke and return stroke positions for the percussion piston; and a control valve which is a component of one of the guide unit and the percussion hammer itself, and which is one of a pressure shut-off valve and a pressure-limiting valve, connected to the pressure inlet line for monitoring the fluid pressure in the pressure inlet line, and connected to the control means for causing the percussion hammer to be stopped automatically by at least one of blocking the pressure inlet line and holding the control means in one of its operating stroke and return stroke positions if the operating pressure in the fluid pressure inlet line exceeds a specified maximum value wherein the control valve is disposed in an auxiliary pressure line connected to the pressure inlet line and the control means such that the control means is blocked in one of its operating stroke and return stroke positions once the maximum operating pressure value on the control valve is exceeded.

3. A device according to claim 2, wherein the control valve is a pressure shut-off valve provided with a double piston disposed in a cylinder and having a reset device disposed in the cylinder and acting on the double piston in a direction of the opened position of the control valve, a valve chamber formed in the control valve cylinder and effective to cause the double piston to move in a direction toward the closed position of the control valve when the valve chamber is charged with pressure, and with the valve chamber being connected to the pressure inlet line via the pressure inlet and via a control line which opens into the valve chamber adjacent one end surface of the double piston.

4. A device according to claim 2, wherein the control valve is a pressure-limiting valve whose inlet and whose control line are both connected to the pressure inlet line provided with the operating pressure.

5. A device according to claim 4, wherein the control means is connected to the pressure-limiting valve and responsive to the condition thereof such that in the opened position of the pressure limiting valve, the control means is blocked in the operating stroke position after the maximum operating pressure value has been exceeded.

6. A device according to claim 2, wherein: the control valve is a pressure-limiting valve having a control line connected to the pressure inlet line that is provided with the operating pressure, and having an outlet connected to a non-pressurized return-flow line; and, the control means is responsive to the pressure limiting valve assuming its open position, when the maximum operating pressure value is exceeded, to block in the return stroke position.

7. A fluid-powered impact vibrator comprising: a fluid-powered percussion hammer having a percussion piston that can be moved back and forth within a cylinder housing by controlled fluid pressure, and a guide unit on which the percussion hammer is supported; control means, connected between a fluid pressure inlet line and a pressure inlet to the cylinder housing, for controlling the back and forth movement of said percussion piston, with the control means including a valve moveable between operating stroke and return stroke positions for the percussion piston; and a control valve which is a component of one of the guide unit and the percussion hammer itself, and which is one of a pressure shut-off valve and a pressure-limiting valve, connected to the pressure inlet line for monitoring the fluid pressure in the pressure inlet line, and connected to the control means for causing the percussion hammer to be stopped automatically by at least one of blocking the pressure inlet line and holding the control means in one of its operating stroke and return stroke positions if the operating pressure in the fluid pressure inlet line exceeds a specified maximum value, wherein the control valve is disposed in an auxiliary pressure line connected to the pressure inlet line and the control means such that the control means is blocked in one of its operating stroke and return stroke positions once the maximum operating pressure value on the control valve is exceeded; and wherein the control valve is a pressure shut-off valve which is connected in a reversing pressure line from the cylinder of the percussion hammer to the control means; said control valve has a control line connected to the pressure inlet line that is provided with the operating pressure; and said control valve is responsive to the maximum operating pressure value being exceeded to assume a blocked position, thereby causing the reversing line and the downstream control means to be blocked, thereby preventing further percussion piston movement.

8. A device according to claim 1, wherein the control valve is a pressure shut-off valve provided with a double piston disposed in a cylinder and having a reset device disposed in the cylinder and acting on the double piston in a direction of the opened position of the control valve, a valve chamber formed in the control valve cylinder and effective to cause the double piston to move in a direction toward the closed position of the control valve when the valve chamber is charged with pressure, and with the valve chamber being connected to the pressure inlet line via the pressure inlet and via a control line which opens into the valve chamber adjacent one end surface of the double piston.

* * * * *